US005743183A

United States Patent [19]

Hummel et al.

[11] Patent Number: 5,743,183

[45] Date of Patent: Apr. 28, 1998

[54] DAMPENING UNIT FOR AN OFFSET PRINTING MACHINE

[75] Inventors: Peter Hummel, Offenbach am Main; Robert Ortner, Alzenau, both of Germany

[73] Assignee: MAN Roland Druckmaschinen AG, Germany

[21] Appl. No.: 694,990

[22] Filed: Aug. 9, 1996

[30] Foreign Application Priority Data

Aug. 9, 1995 [DE] Germany ..... 195 29 204.9

[51] Int. Cl.[6] ..... B41L 23/00

[52] U.S. Cl. ..... 101/147; 101/352.11

[58] Field of Search ..... 101/147, 148, 101/348, 352.11

[56] References Cited

U.S. PATENT DOCUMENTS

| | | | |
|---|---|---|---|
| 3,911,815 | 10/1975 | Banfer | 101/148 |
| 4,373,442 | 2/1983 | Dahlgren et al. | 101/148 |
| 4,724,764 | 2/1988 | MacPhee et al. . | |
| 4,932,319 | 6/1990 | Switall | 101/147 |
| 5,027,704 | 7/1991 | Holl et al. . | |
| 5,191,835 | 3/1993 | Blanchard | 101/148 |

FOREIGN PATENT DOCUMENTS

| | | |
|---|---|---|
| 139 816 | 1/1980 | Germany . |
| 30 16 366 A1 | 12/1980 | Germany . |
| 31 32 223 A1 | 4/1982 | Germany . |
| 34 32 807 A1 | 6/1985 | Germany . |
| 39 08 044 C1 | 5/1990 | Germany . |
| 44 04 989 A1 | 8/1995 | Germany . |

*Primary Examiner*—Eugene H. Eickholt
*Attorney, Agent, or Firm*—Leydig, Voit & Mayer, Ltd.

[57] ABSTRACT

A dampening unit for an offset printing machine having a plate cylinder which carries a printing form and which is operatively connected to applicator rollers of an inking unit and of a dampening unit. To improve the print quality appreciably by means of uniform, fault-free feed of dampening medium to the plate cylinder, particularly during the processing of special inks having relatively high metallic pigment components, a dampening applicator roller receives a feed of dampening medium upstream of the contact point with the plate cylinder, and a first auxiliary roller receives dampening medium from the dampening applicator roller and a second auxiliary roller receives printing ink from the dampening applicator roller with the plate cylinder at contact points with the dampening medium applicator roller downstream of this contact point for the dampening applicator roller.

13 Claims, 1 Drawing Sheet

DAMPENING UNIT FOR AN OFFSET PRINTING MACHINE

FIELD OF THE INVENTION

The present invention relates generally to dampening units for offset printing machines, and more particularly, to dampening units that are operatively connected between an inking unit and a plate cylinder which carries a printing form.

BACKGROUND OF THE INVENTION

A dampening unit of the foregoing type is shown in German patent publication DE 3 416 485 A1. In this reference, the dampening unit includes a feed device for the dampening medium, a device for metering the dampening medium film, and an applicator roller which transfers the dampening medium film onto a plate cylinder and which can be coupled to an adjacent inking unit or operated separately. The dampening applicator roller in this case can be operated at a different circumferential speed than the plate cylinder so that a resulting wiping effect eliminates foreign particles.

German patent publication DE 3 432 807 A1, in conjunction with U.S. Pat. No. 4,724,764, discloses a more refined dampening unit. In addition to selectively operating the plate cylinder and dampening applicator roller at different circumferential speeds, an ink receiving roller, called a rider roller, is provided for the damping applicator roller. In this case, the ink-receiving roller rotates at a circumferential speed different from the plate cylinder and can be coupled to an adjacent inking unit or be operated separately.

A disadvantage of the foregoing prior art dampening units is that ink accumulating on the dampening applicator roller is carried into the dampening unit and consequently the ink/dampening medium equilibrium can become impaired. These impairments can take the form of stencilling (shadow-like markings) or cord streaks or striations which cause uneven printing.

OBJECTS AND SUMMARY OF THE INVENTION

It is an object of the present invention to provide an improved dampening unit for offset printing presses which is adapted for effecting uniform, fault-free feed of a dampening medium to the plate cylinder, particularly during the processing of special inks in the form of printing inks having metallic pigment components, such as fancy inks or zinc white.

These objects are carried out in a dampening unit having at least one dampening applicator roller and at least one first auxiliary or rider roller for receiving dampening medium from the dampening applicator roller downstream of the contact point of the dampening applicator roller and plate cylinder. A second or tandem auxiliary roller, but receiving printing ink, is adjacent to the rider roller and likewise in contact with the applicator roller. A desired water and ink structure can be formed on the dampening applicator roller downstream of the contact point of the dampening roller and plate cylinder. The roller receiving dampening medium separates the dampening medium from the printing ink so that the downstream roller (tandem roller) receiving printing ink levels off the remaining ink structure. If the ink/dampening medium mixture structure is not levelled off completely, it leads to unstable dampening. Due to a dampening medium friendly surface of the rider roller, a better exchange of residual water therefore takes place between the ink carrying dampening applicator roller, the rider roller and, in turn, the dampening applicator roller. The second or tandem auxiliary roller receiving the printing ink equalizes the printing ink which is carried on the dampening applicator roller and which has, in particular, greater pigment components. A uniform surface structure is obtained on the dampening applicator roller after the contact of the rider roller receiving dampening medium and the tandem roller receiving printing ink. This roller arrangement reduces the tendency of shadow-like marking, (stencilling) in surface printing and the cord-like streaks which cause uneven printing. It has been found that in a dampening unit according to the present invention, the feed of dampening medium from the dampening duct roller can be reduced and the use of alcohol also can be reduced. The roller arrangement guarantees that the ink/dampening-medium equilibrium is reached quickly, while ensuring a constant production of a very thin dampening film in conjunction with the dampening metering device.

Other objects and advantages of the invention will become apparent upon reading the following detailed description and upon reference to the drawings, in which:

Figure 1:
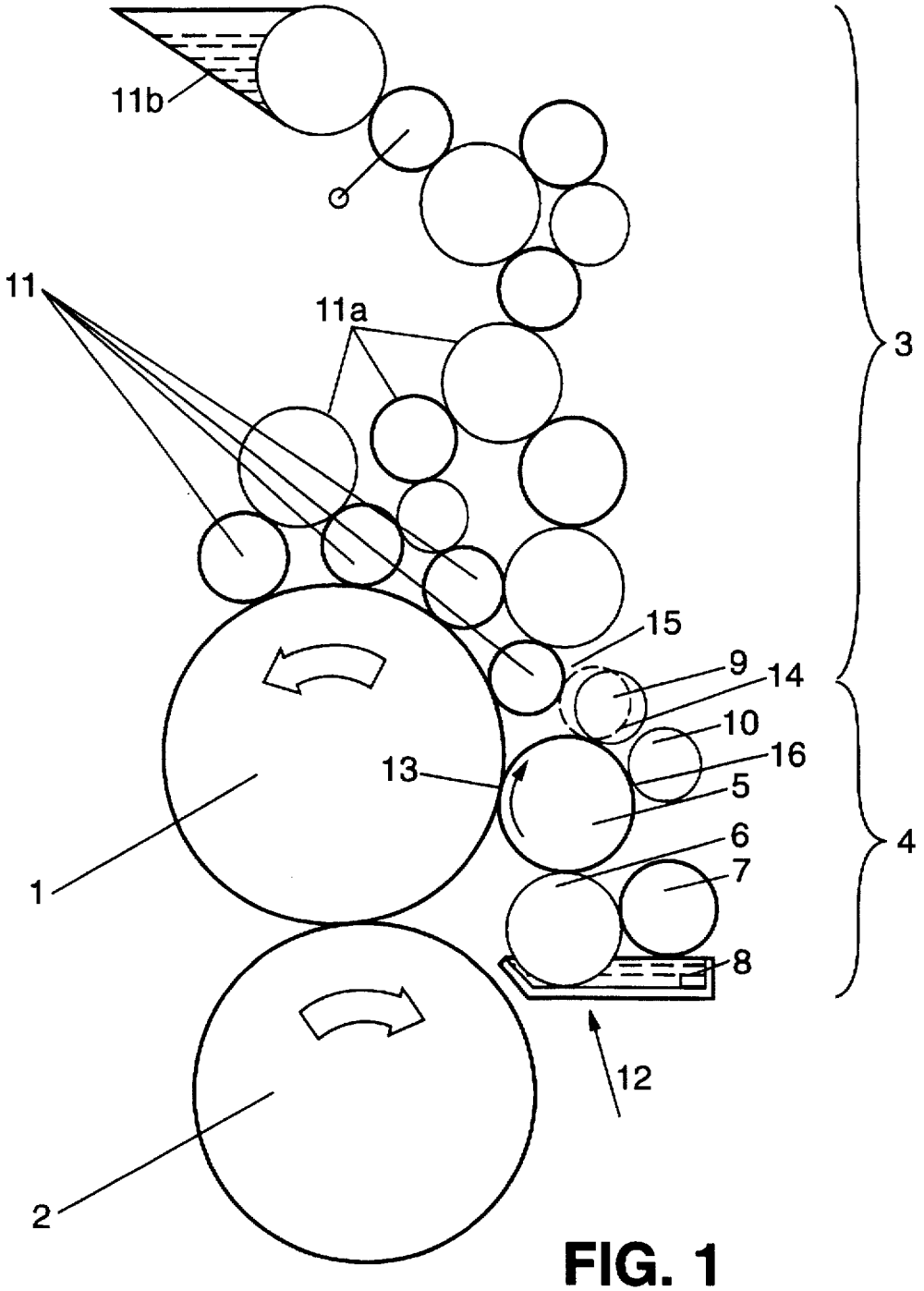
FIG. 1 is a diagrammatic depiction of a printing unit having a dampening unit according to the invention shown in uncoupled relation to an inking unit.

While the invention is susceptible of various modifications and alternative constructions, a certain illustrated embodiment thereof has been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

DETAILED DESCRIPTION OF THE DRAWINGS

Referring now more particularly to the FIG. 1 of the drawings, there is shown a rotatable plate cylinder 1 of an offset printing machine having a dampening unit 4 in accordance with the present invention. For supplying ink to the plate cylinder, an inking unit 3 is provided, which comprises a plurality of ink applicator rollers 11 connected to ink feeding rollers **11*a* and ink supply 11*b* in a conventional way. The ink applicator rollers 11 are disposed in contacting relation with the plate cylinder 1 at circumferentially spaced intervals about the perimeter of the plate cylinder, and preferably, may be adapted for throw-on and throw-off movement. Rotational movement of the applicator roller may be transmitted from the plate cylinder 1 to the ink applicator rollers 11** non-positively through their friction contact.

For supplying a dampening medium to the plate cylinder 1, the dampening unit 4 includes a dampening applicator roller 5 disposed in contacting relation to the plate cylinder 1 at a point 13 which precedes the inking unit 3, as seen in the direction of rotation of the plate cylinder 1. For supplying dampening medium to the dampening applicator roller 5, the dampening unit includes a dampening feed device 12 which includes a dampening medium container 8, a dampening duct roller 6 in contacting relation with the dampening applicator roller 5 and disposed within the dampening medium container 8, and a dampening metering roller 7 in contacting relation to the duct roller 6 for creating a thin dampening medium film on the duct roller 6 for transfer to the dampening applicator roller 5.

In accordance with the invention, a first auxiliary roller is provided for receiving dampening medium from the applicator roller and a second or tandem auxiliary roller is provided for receiving printing ink from the dampening applicator roller, said auxiliary rollers being in contacting relationship with the dampening applicator roller downstream of the contact point of the dampening applicator roller with the plate cylinder. To this end, in the illustrated embodiment, a first auxiliary roller in the form of a rider roller 9 having a surface adapted for receiving the dampening medium is mounted in contacting relation with the dampening applicator roller at a contact point 14 at a point downstream of the contact point 13 between the dampening applicator roller 5 and the plate cylinder 1, as seen in the direction of travel of the dampening applicator roller, and a second auxiliary roller 10 having a surface adapted for receiving printing ink is mounted in contacting relation with the dampening applicator roller at a contact point 16 also downstream of the contact point 13 between the dampening applicator roller 5 and the plate cylinder 1. In the illustrated embodiment, the second auxiliary roller 10 is arranged downstream of the first auxiliary roller 9, as viewed in the direction of rotation of the dampening applicator roller 5. The auxiliary roller 9 preferably has a surface coating composed of a matt chromium. Alternatively, the auxiliary roller 9 may have a surface consisting of high grade steel or ceramic material capable of receiving dampening medium. The roller surface also may be made of silicon metal or a silicon containing coating. The second auxiliary roller 10 preferably has a surface coating composed of plastic, for example, Rilsan.

The dampening applicator roller 5 may be operated by a conventional reversible positive drive at a circumferential speed which is equal to or different from the circumferential speed of the plate cylinder 1. The auxiliary rollers 9 and 10 similarly have a drive which can rotate the rider roller with a circumferential speed equal to or different from the circumferential speed of the dampening applicator roller. The rollers 9 and 10 also preferably has a transverse drive of a known type for moving the rider roller axially relative to the dampening applicator roller.

In keeping with the invention, the auxiliary roller 9 is operable as a bridge roller, being selectively movable from the solid line position shown in FIG. 1, into contacting relation with the inking unit. In the illustrated embodiment, the auxiliary roller 9 is movable into contacting relation with an ink applicator roller 11 of the inking unit 3 which is the first of the ink applicator rollers, as seen in the direction of rotation of the plate cylinder. Such movement may be effected by an appropriate reciprocating mechanism. The switched position of the ink auxiliary roller 9, as seen in broken lines in FIG. 1, is used for coupling the dampening unit 4 to the inking unit 3 for the purpose of washing the ink applicator rollers 11.

In the printing mode of operation of the printing machine, the dampening unit 4 is uncoupled from the inking unit 3 at a separating point 15 since the auxiliary roller 9 guiding dampening medium is separated from the first ink applicator roller 11. The dampening applicator roller 5 is operated via its reversible positive drive at a circumferential speed equal to or differing from the circumferential speed of the plate cylinder 1, and rotational movement is transmitted from the plate cylinder 1 to the ink applicator rollers 11. In addition to the dampening applicator roller 5, the auxiliary roller 9 carrying dampening medium can also be operated at a circumferential speed different from or equal to that of the dampening applicator roller 5. At the same time, the roller 10 located downstream of the roller 9 can likewise be operated at a circumferential speed different from or equal to that of the dampening applicator roller 5. The cylinder generatrix of the rollers 9 and 10 is preferably identical to the length of the arc of the circle of the channel of the plate cylinder 1.

Depending on the printing requirements, a desired structure of dampening medium and ink is formed on the dampening applicator roller 5 downstream of the contact point 13 of the dampening applicator roller 5/plate cylinder 1. This structure is levelled or altered by the dampening medium receiving roller 9. The surface structure of the ink/dampening medium mixture, particularly in the case of printing inks having relatively high metallic pigment components, is distributed uniformly on the dampening applicator roller 5 by the roller 10 receiving printing ink. In addition to the dampening medium feed device 12, the auxiliary roller 9 has a blocking function on the ink applicator roller 5, the blocking function relative to the ink which appreciably prevents the return transport of printing ink 5 into the dampening unit 4 and at the same time guarantees stable metering of dampening medium in the form of a very thin dampening film.

What is claimed is:

1. An offset printing machine comprising a rotatable plate cylinder having a printing form, an inking unit having at least one rotatable ink applicator roller for transferring ink to the plate cylinder, a dampening unit having at least one rotatable dampening applicator roller adjacent to said plate cylinder for transferring a dampening medium to said plate cylinder at a determined contact point, a dampening medium feed device for supplying dampening medium to said dampening applicator roller at a contact point in front of the contact point of said dampening applicator roller with plate cylinder in the direction of rotation of said dampening applicator roller, and a first auxiliary roller having a surface made of a material for receiving dampening medium from the dampening applicator roller and a second auxiliary roller having a surface made of a material different from the surface material of said first auxiliary roller for receiving printing ink from the dampening applicator roller, said auxiliary rollers being mounted in contact with the dampening applicator roller after the contact point between the dampening applicator roller and the plate cylinder.

2. The offset printing machine of claim 1 in which said dampening applicator roller is rotatable at a circumferential speed which is the same as a circumferential speed of the rotatable plate cylinder.

3. The offset printing machine of claim 1 in which said dampening applicator roller is rotatable at a circumferential speed different from the circumferential speed of the rotatable plate cylinder.

4. The offset printing machine of claim 1 in which said auxiliary rollers are rotatable at circumferential speeds substantially equal to a circumferential speed of the rotatable dampening applicator roller.

5. The offset printing machine of claim 2 in which said auxiliary rollers each are for axially movable relative to the dampening applicator roller.

6. The offset printing machine of claim 1 in which said first auxiliary roller has a surface composed of chromium.

7. The offset printing machine of claim 1 in which said first auxiliary roller has a surface composed of steel.

8. The offset printing machine of claim 1 in which said first auxiliary roller has a surface composed of a ceramic.

9. The offset printing machine of claim 1 in which said first auxiliary roller has a surface which contains plastic.

10. The offset printing machine of claim 1 in which said second auxiliary roller has a surface composed of plastic.

11. An offset printing machine comprising a rotatable plate cylinder having a printing form, an inking unit having at least one rotatable ink applicator roller for transferring ink to the plate cylinder, a dampening unit having at least one rotatable dampening applicator roller adjacent to said plate cylinder for transferring a dampening medium to said plate cylinder at a determined contact point, a dampening medium feed device for supplying dampening medium to said dampening applicator roller at a contact point in front of the contact point of said dampening applicator roller with plate cylinder in the direction of rotation of said dampening applicator roller, and at least one auxiliary roller having a surface made of a material for receiving dampening medium from the dampening applicator roller and at least one auxiliary roller having a surface made of a material for receiving printing ink from the dampening applicator roller, said auxiliary rollers being mounted in contact with the dampening applicator roller after the contact point between the dampening applicator roller and the plate cylinder and being rotatable at circumferential speeds different from a circumferential speed of the rotatable dampening applicator roller.

12. An offset printing machine comprising a rotatable plate cylinder having a printing form, an inking unit having at least one rotatable ink applicator roller for transferring ink to the plate cylinder, a dampening unit having at least one rotatable dampening applicator roller adjacent to said plate cylinder for transferring a dampening medium to said plate cylinder at a determined contact point, a dampening medium feed device for supplying dampening medium to said dampening applicator roller at a contact point in front of the contact point of said dampening applicator roller with plate cylinder in the direction of rotation of said dampening applicator roller, and a first auxiliary roller having a surface made of a material for receiving dampening medium from the dampening applicator roller and a second auxiliary roller having a surface made of a material for receiving printing ink from the dampening applicator roller, said auxiliary rollers being mounted in contact with the dampening applicator roller after the contact point between the dampening applicator roller and the plate cylinder, and said first auxiliary roller being a bridge roller that is selectively movable into contacting engagement with said inking unit.

13. An offset printing machine comprising a rotatable plate cylinder having a printing form, an inking unit having at least one rotatable ink applicator roller for transferring ink to the plate cylinder, a dampening unit having at least one rotatable dampening applicator roller adjacent to said plate cylinder for transferring a dampening medium to said plate cylinder at a determined contact point, a dampening medium feed device for supplying dampening medium to said dampening applicator roller at a contact point in front of the contact point of said dampening applicator roller with plate cylinder in the direction of rotation of said dampening applicator roller, and a first auxiliary roller having a surface made of a material for receiving dampening medium from the dampening applicator roller and a second auxiliary roller having a surface made of a material for receiving printing ink from the dampening applicator roller, said auxiliary rollers being mounted in contact with the dampening applicator roller after the contact point between the dampening applicator roller and the plate cylinder, said first auxiliary roller being disposed and spaced apart uncoupled relation to said inking unit during a printing mode of operation of said machine, and said first auxiliary roller being selectively moveable into contacting engagement with the printing unit during a non-printing operating mode of the machine.

* * * * *